US005450928A

United States Patent [19]

Isogai

[11] Patent Number: 5,450,928

[45] Date of Patent: Sep. 19, 1995

[54] LIFT USED FOR MAINTENANCE AND REPAIR OF AUTOMOBILES

[75] Inventor: Shunji Isogai, Hekinan, Japan

[73] Assignee: Sugiyasu Industries Co., Ltd., Takahama, Japan

[21] Appl. No.: 231,383

[22] Filed: Apr. 22, 1994

Related U.S. Application Data

[63] Continuation-in-part of Ser. No. 14,691, Oct. 28, 1993, Pat. No. Des. 349,802.

[30] Foreign Application Priority Data

Apr. 28, 1993 [JP] Japan ..... 5-027907

[51] Int. Cl.[6] ..... B66F 7/08

[52] U.S. Cl. ..... 187/205; 187/208; 187/215

[58] Field of Search ..... 187/203, 204, 205, 206, 187/207, 208, 210, 215, 218; 254/1, 2 B, 9 B, 9 C, 45, 90, 8 R, 124, 133 A, 133 R; D34/28, 31, 33

[56] References Cited

U.S. PATENT DOCUMENTS

| | | | |
|---|---|---|---|
| D. 343,488 | 1/1994 | Fletcher | D34/28 |
| 2,476,380 | 7/1949 | Manke | 254/2 B |
| 2,766,007 | 10/1956 | Krilanovich | 254/2 B X |
| 3,168,284 | 2/1965 | Fisher | 254/8 R |
| 3,347,342 | 12/1967 | Hott | 187/205 X |
| 3,367,449 | 2/1968 | Pelouch | 187/205 |
| 3,671,013 | 6/1972 | Everson, Jr. et al. | 254/8 R |
| 4,690,378 | 4/1987 | Jarman et al. | 254/2 B X |
| 4,792,272 | 12/1988 | Oswald et al. | 254/9 C X |
| 4,828,222 | 5/1989 | Rossato | 254/88 |
| 4,848,732 | 7/1989 | Rossato | 254/90 |
| 4,901,980 | 2/1990 | Hansen | 254/9 C |
| 4,982,595 | 1/1991 | Fiorese | 187/204 X |
| 5,016,858 | 5/1991 | Mitchell | 254/45 |

FOREIGN PATENT DOCUMENTS

| | | |
|---|---|---|
| 4-50310 | 11/1929 | Japan . |
| 62-264197 | 11/1987 | Japan . |
| 63-24192 | 2/1988 | Japan . |

*Primary Examiner*—William E. Terrell
*Assistant Examiner*—Dean A. Reichard
*Attorney, Agent, or Firm*—Lahive & Cockfield

[57] ABSTRACT

The present invention provides a lift used for automobile maintenance, which has a novel link mechanism consisting of a smaller number of parts required to have significantly high precision, and is manufactured at a relatively low cost. The lift allows a mechanic to check and repair a lower portion of a vehicle in a standing attitude. The link mechanism of the invention has a smaller number of joints, thus effectively preventing excessive looseness of the lift even after long-term use. The lift of the invention includes a pair of base elements placed in a pair of pits, a pair of tables for supporting a lower body frame of a vehicle other than four wheels, and a pair of link mechanisms where a long arm crosses and is fixed to a short arm at a position in the middle of the long arm via a center shaft. Each short arm is integrally fixed at a first end thereof to a connection shaft, which is rotatably attached to one side of the base elements. Each long arm has a first end pivotably attached to the table and a second end with a roller slidably movable along a pair of curved rails formed on the base element. In response to the sliding movement of the second end of the long arm along the pair of curved rails, the table descends to a lower most position or ascends to an upper most position. The link mechanism further includes a push rod for joining a second end of the short arm with the table.

5 Claims, 5 Drawing Sheets

LIFT USED FOR MAINTENANCE AND REPAIR OF AUTOMOBILES

This application is a continuation-in-part of application Ser. No. 29/014,691, filed Oct. 28, 1993, now U.S. Pat. No. Des. 349,802.

BACKGROUND OF THE INVENTION

1. Field of the Invention

The present invention relates to a lift used for maintenance and repair of automobiles, which includes an inverse Y-shaped link mechanism.

2. Description of the Related Art

A lift used for maintenance of a vehicle generally includes a table for supporting a lower body frame of the vehicle, an X-shaped link mechanism for vertically moving the table, and a base which one end of the X-shaped link mechanism is fixed to. The table should be lifted up to a height of 1,800 mm by the X-shaped link mechanism to allow a mechanic to check and repair a lower portion of the vehicle in a standing attitude. The preferable length of the table is, on the other hand, not greater than 1,500 mm for effectively supporting a lower body frame of a compact car other than four wheels. A long-armed link mechanism is not suitable for moving such a short table. For maintenance of the compact car, a conventional lift has a multiple-stage X-link mechanism including a plurality of, generally two, short-armed X-link units 110 and 120 vertically disposed in series between a table 100 and a base 130 as shown in FIG. 6. The multiple-stage X-link mechanism requires a greater number of parts and higher precision of arm elements and thereby becomes more expensive than a standard one-stage X-link mechanism. A number of joints in the multiple-stage X-link mechanism are significantly loosened through a long-term use of the lift.

SUMMARY OF THE INVENTION

One object of the invention is thus to provide a lift used for automobile maintenance having a novel link mechanism consisting of a smaller number of parts which are required to have significantly high precision.

Another object of the invention is to provide such a lift manufactured at a relatively low cost.

Still another object of the invention is to allow a mechanic to check and repair a lower portion of a vehicle in a standing attitude.

A further object of the invention is to reduce a number of joints used in a link mechanism of the lift, thus effectively preventing excessive looseness of the lift even after long-term use.

The above and other related objects are realized by a lift used for maintenance of an automobile, including (a) a table having a first side and a second side for supporting a lower body frame of the automobile, (b) a base having a first side and a second side, and (c) a link mechanism including a short arm, a long arm, and a push rod for moving the table in a vertical direction between an upper most position or a maintenance position and a lower most position or a collapsed position, the short arm having a first end fixed to the first side of the base to allow a pivotal movement of the short arm and a second end opposite to the first end, the long arm crossing and fixed to the short arm at a position in the vicinity of the second end of the short arm and in the middle of the long arm to allow a pivotal movement of the long arm with respect to the short arm, the long arm having a first end pivotably attached to the first side of the table and a second end slidably movable along a guide member with a sliding face formed on the base, the table descending to the lower most position and ascending to the upper most position in response to the sliding movement of the second end of the long arm along the sliding face of the guide member, the push rod pivotally joining the second end of the short arm with the table at a position between an intersection of the short arm and the long arm and the first side of the table, wherein the sliding face of the guide member, which the second end of the long arm slidably moves along, has a compensation curve corresponding to an angle of the table inclined by an ascending or descending movement of the table.

The sliding face of the guide member having a compensation curve allows the table to move between the lower most position and the upper most position while keeping the table in parallel with the base.

It is preferable that the push rod has a length adjustable by a turnbuckle mechanism.

The turnbuckle mechanism changes the length of the push rod to vary an inclination of the table.

The base may be placed on a bottom of a pit having an opening and a pit cover. The pit cover has a first side rotatably fixed to the opening of the pit and a second side pressed up in response to the ascending or descending movement of the long arm and falling down to close the opening when the table is in its lower most position or in its upper most position.

The link mechanism presses up the pit cover during ascending or descending movement of the table and allows the pit cover to fall down and close the opening of the pit when the link mechanism is in its maintenance position or collapsed position.

These and other objects, features, aspects, and advantages of the present invention will become more apparent from the following detailed description of the preferred embodiments with the accompanying drawings.

DETAILED DESCRIPTION OF THE PREFERRED EMBODIMENT

A lift used for maintenance of automobiles according to the invention is described more in detail with accompanied drawings.

Figure 1:
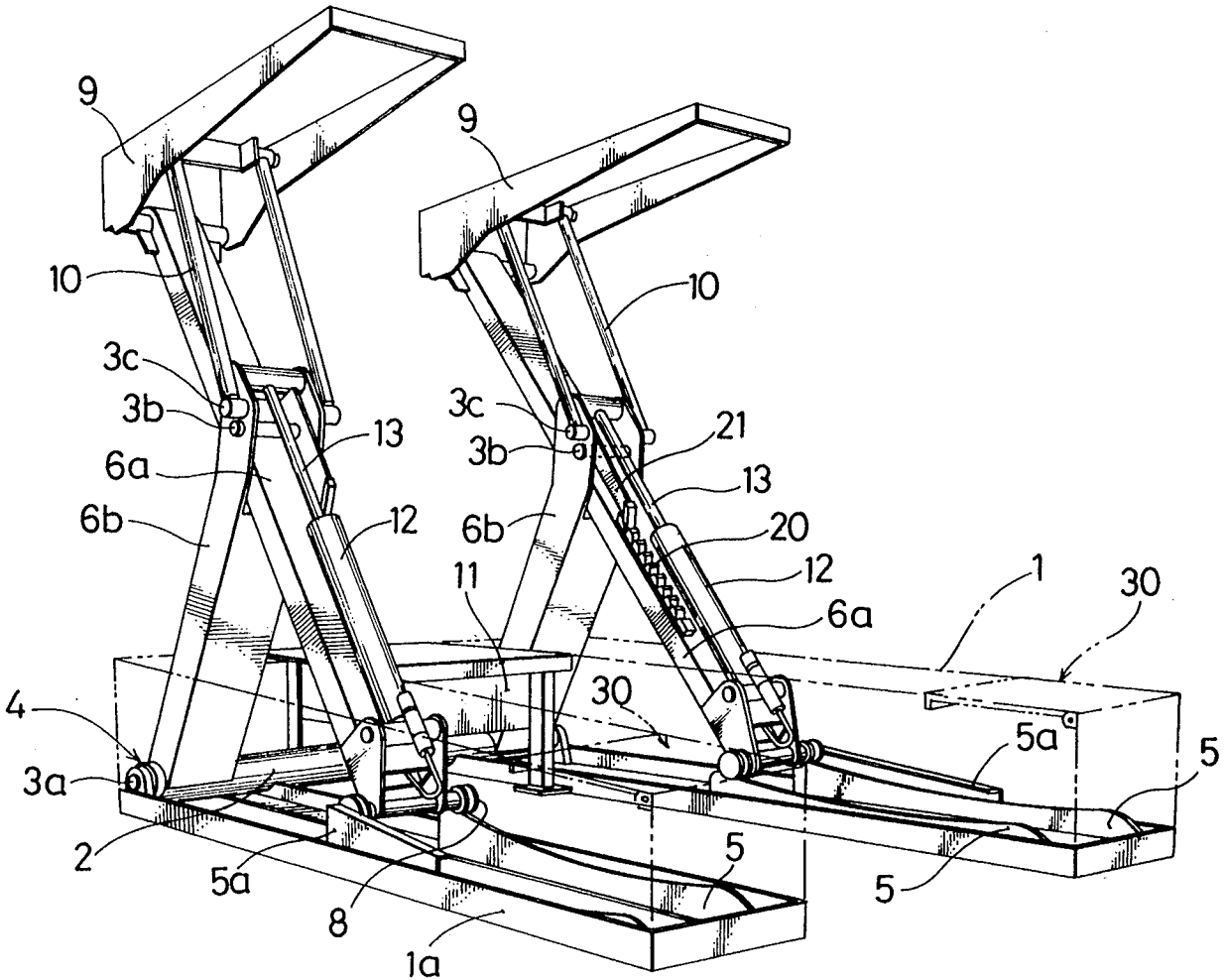
FIG. 1 is a perspective view showing a lift used for maintenance of automobiles as a first embodiment according to the invention.

A pair of rectangular pits 1,1 formed under a floor surface are disposed in parallel at an interval approximately equal to the mean width of automobiles as shown in the perspective view of FIG. 1. The pair of rectangular pits 1,1 are connected with each other on each one end thereof via a connection passage 2 disposed perpendicular to the longitudinal direction of the pits 1,1. Namely, the pair of rectangular pits 1,1 and the connection passage 2 form a U shape in a horizontal plane. A connection shaft 3*a* running through the connection passage 2 from one pit 1 to the other pit 1 is fixed to a pair of base elements 1*a*,1*a* via a pair of bearing units 4,4 to allow a pivotal movement of the connection shaft 3*a*. A pair of curved rails 5,5 are disposed in each pit 1 in the vicinity of a free end of the pit 1.

Figure 2:
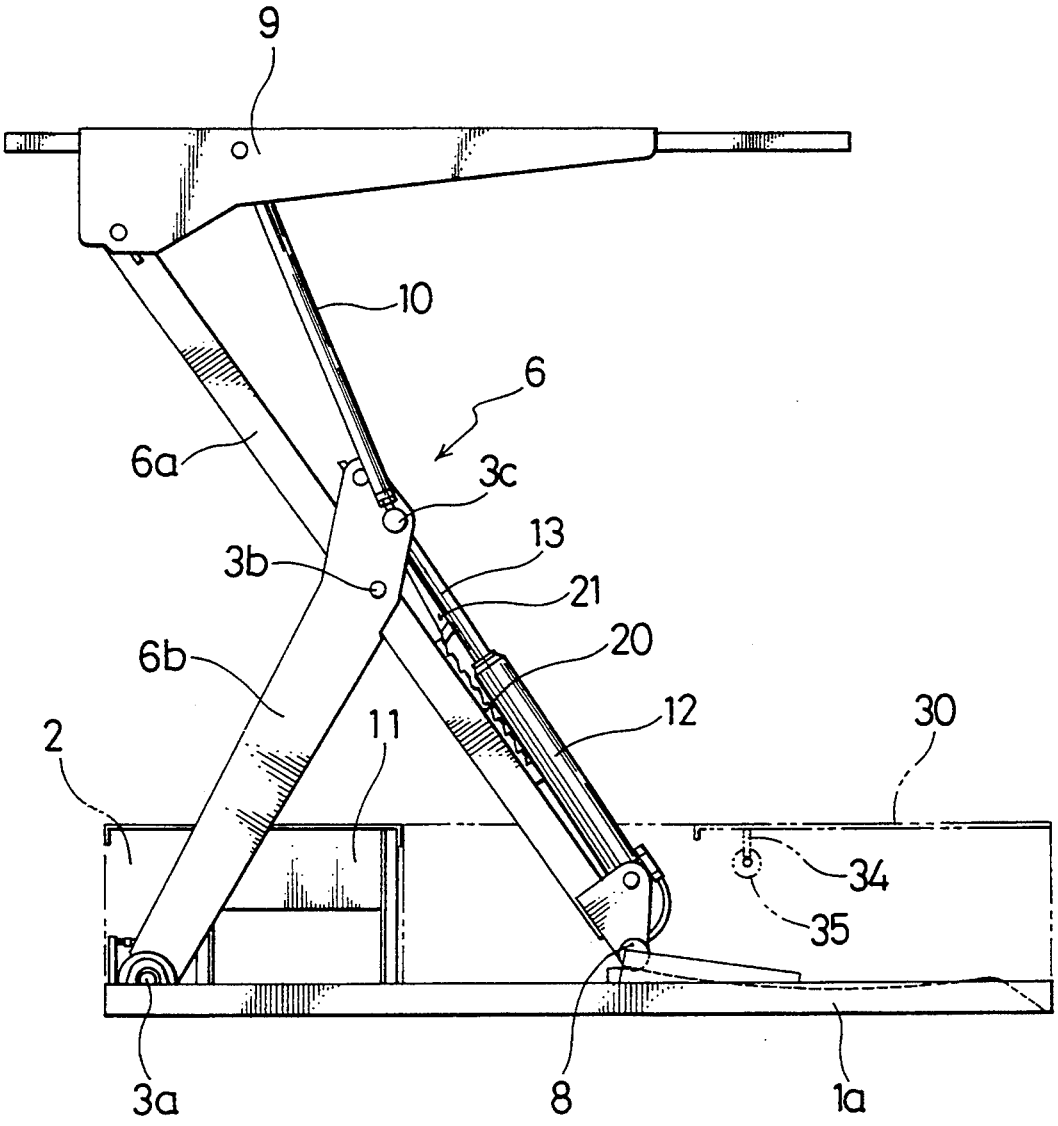
FIG. 2 is a side view showing the lift of the embodiment stretched to its maintenance position.

FIG. 2 is a side view showing the lift of the embodiment stretched to its maintenance position. The lift further includes a pair of inverse Y-shaped link mechanisms 6,6 and a pair of tables 9,9 pivotally mounted on the link mechanisms 6,6 for supporting a lower body frame of a vehicle other than four wheels. Each link mechanism 6 includes a long arm 6*a* crossing and fixed to a short arm 6*b* at a position in the middle of the long arm 6*a* and in the vicinity of a second end of the short arm 6*b* via a center shaft 3*b* to allow a pivotal movement of the long arm 6*a* with respect to the short arm 6*b*. Each short arm 6*b* is integrally fixed at a first end thereof to the connection shaft 3*a*, which is rotatably attached to one side of the base elements 1*a*,1*a*. Each long arm 6*a* has a first end pivotably attached to one side of the table 9 and a second end with a roller 8 slidably movable along a pair of curved rails 5,5 formed on the base element 1*a*. In response to the sliding movement of the second end of the long arm 6*a* along the pair of curved rails 5,5, the table 9 descends to a lower most position or ascends to an upper most position. The link mechanism 6 further includes a push rod 10 for pivotally joining the second end of the short arm 6*b* with the table 9 at a position between an intersection of the short arm 6*b* and the long arm 6*a* and the one side of the table 9 where the long arm 6*a* is attached.

The second end of each long arm 6*a* is coupled with a lift up/down cylinder 12 connecting to a pressurizing device 11 installed in the connection passage 2. A piston 13 stretched from and contracted into the lift up/down cylinder 12 is fixed to the second end of the short arm 6*b* via a fixing shaft 3*c*.

The pair of curved rails 5,5 form a guide member having a sliding face which the second end of the long arm 6*a* slidably moves along, and compensate the height of the second end of the long arm 6*a* in order to keep the table 9 in parallel with the base 1*a* during an ascending movement of the table 9 via the link mechanism 6. The curvature of the compensation curve of the rails 5,5 is arithmetically or experimentally determined corresponding to lengths of the long arm 6*a* and the short arm 6*b* and an angle of the table 9 inclined by the ascending or descending movement of the table 9.

A roller stop 5*a* is attached to each rail 5 to prevent the lift in the ascended position from rolling over towards the connection shaft 3*a*. The roller stop 5*a* may be a U-shaped rail, groove, or slit.

Figure 3:
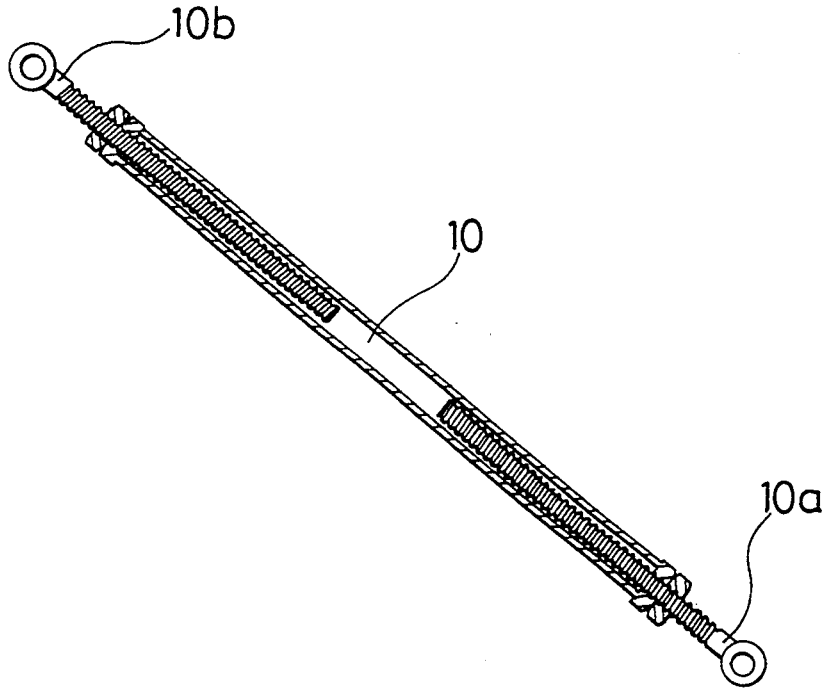
FIG. 3 shows a push rod of a link mechanism applied in the embodiment.

The length of the push rod 10 can be adjusted by a turnbuckle mechanism including a right-handed screw 10*a* and a left-handed screw 10*b* on either end thereof as shown in FIG. 3. The length of the push rod 10 is set appropriately after installment of the lift in order to keep the table 9 in parallel with the base la in the ascending movement.

Figure 4:
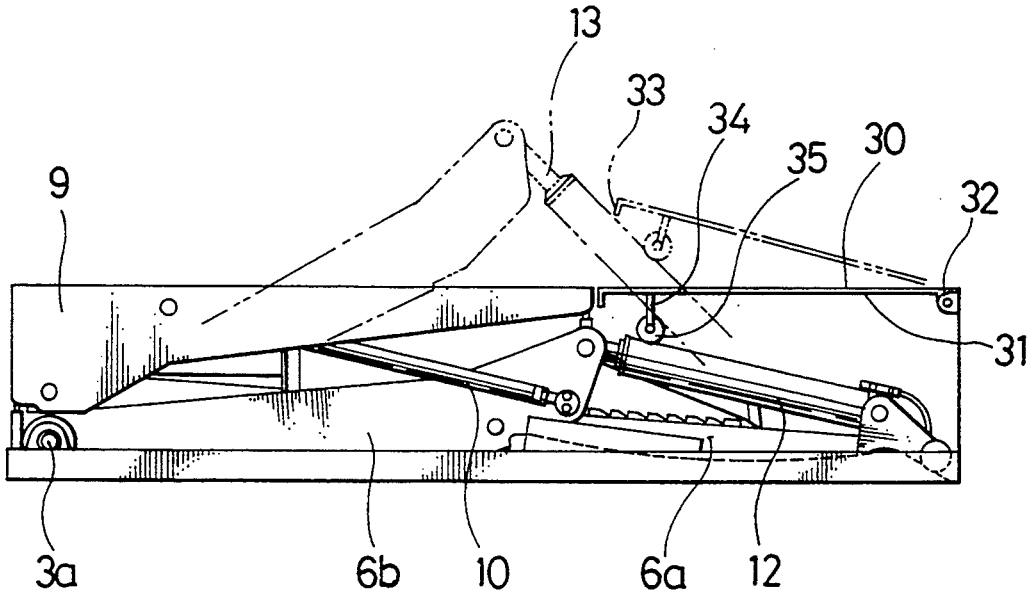
FIG. 4 is a side view showing the lift of the embodiment compressed to its collapsed position.

The lift thus constructed is compressed to its collapsed position as shown by the solid lines, and ascended as shown by the two-dot chain lines in FIG. 4. When working fluid is supplied to the lift up/down cylinder 12, the piston 13 is stretched to press up the second end of the short arm 6*b*. The press-up movement rotates and raises up the short arm 6*b* around the connection shaft 3*a* while the long arm 6*a* is also set up. When the collapsed inverse Y-shaped link mechanism 6 is set up, the roller 8 attached to the second end of the long arm 6*a* rolls along the rails 5,5 in the pit 1 to adjust the height of the second end of the long arm 6*a*, thus keeping the table 9 in parallel with the base 1*a* in its ascending movement.

A rack 20 disposed upward next to the lift up/down cylinder 12 and an engagement click 21 attached to the center shaft 3*b* are engaged with each other to work as a fall-safe unit in the ascending movement of the table 9. This unit effectively prevents the lift from being fallen over even under conditions of abrupt drop of the hydraulic pressure in the lift up/down cylinder 12.

A rectangular pit cover 30 is pivotally fixed at a first side 32 thereof to the free end of the opening of the pit 1. The metal pit cover 30 covers a vacant space of the pit 1 other than that occupied by the table 9 when the lift is in its collapsed position or in its maintenance position. A pair of parallel sides 31,31 of the rectangular pit cover 30 have a width corresponding to the width of the pit 1. A wheel 35 is attached to a rear face of the pit cover 30 via a fixing member 34 which is disposed in the vicinity of a second side 33 of the pit cover 30 opposite to the fist side 32. When the lift in the collapsed position is ascended, the wheel 35 is brought into contact with and rolls along the lift up/down cylinder 12 of the long arm 6*a* as shown in FIG. 4. The lift up/down cylinder 12 presses up the second side 33 of the pit cover 30 in response to the ascending movement of the long arm 6*a* as shown by the two-dot chain lines in FIG. 4. The pit cover 30 thus pressed up opens the pit 1 to allow the lift to rise to its maintenance position. As the lift up/down cylinder 12 moves towards the connection shaft 3*a*, the pit cover 30 gradually goes down to be apart from the lift up/down cylinder 12. The pit cover 30 closes the pit 1 again when the lift is ascended to its maintenance position as shown in FIG. 2. The lift is descended from its maintenance position to its collapsed position in a process reverse to that described above.

A sliding member (not shown) may also be attached to the rear face of the pit cover 30 at a position in the vicinity of the second side 33, so as to slide along the lift up/down cylinder 12 in the ascending or descending movement of the long arm 6*a*. In the embodiment, the rectangular pit cover 30 covers the opening of the pit 1 other than a space occupied by the table 9 when the lift is in its collapsed position or maintenance position. A collapsible auxiliary cover (not shown) for covering a space around the long arm 6*a* and the short arm 6*b* may further be attached to the second side 32 of the pit cover 30. The auxiliary cover is folded when the lift is in its collapsed position as shown in FIG. 4, and spread over to expand a working area when the lift is in its maintenance position as shown in FIG. 2.

As described above, the lift used for automobile maintenance has a novel link mechanism consisting of a smaller number of parts required to have significantly high precision, and is manufactured at a relatively low cost. The lift of the embodiment allows a mechanic to check and repair a lower portion of a vehicle in a standing attitude. The link mechanism has a smaller number of joints, thus effectively preventing excessive looseness of the lift even after long-term use.

The expandable push rod effectively varies the inclination of the table, which is preferably applied to vehicle-riding plates or pallets of parking lifts.

The pit cover attached to the pit covers a specific portion of the opening of the pit other than a space occupied by the table when the lift is in its collapsed position. This effectively prevents a mechanic from falling down the opening of the pit. The pit cover also covers the specific portion of the pit to expand a working area for the mechanic when the lift is in its maintenance position.

Although the lift used for automobile maintenance is described as the embodiment of the invention, the principle of the invention is also applicable to conventional lifting apparatus, parking lifts, and other similar apparatus.

Figure 5:
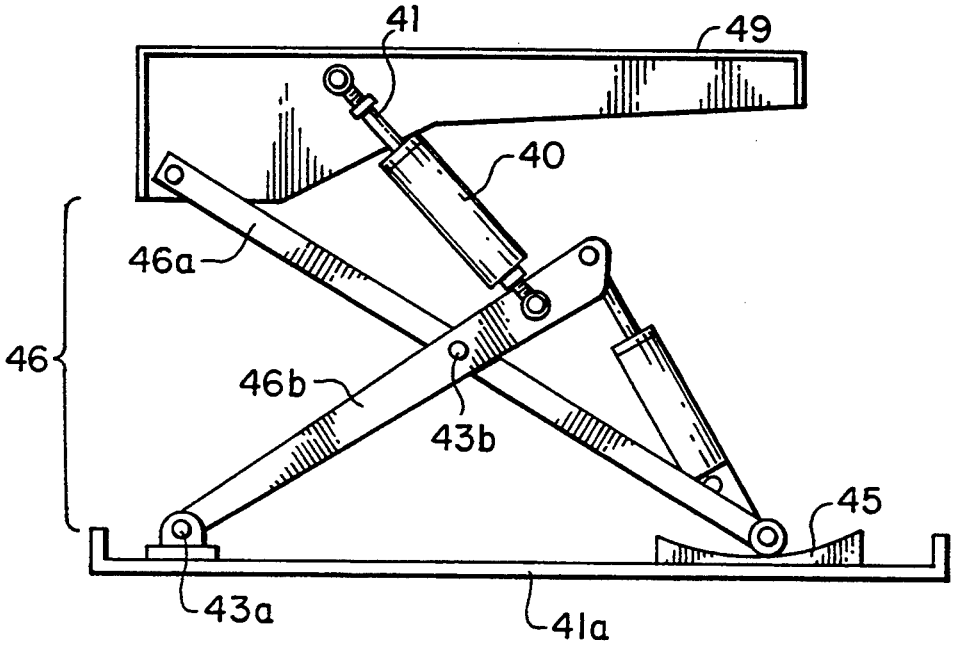
FIG. 5 is a side view showing a lifting apparatus as a second embodiment of the invention.
Figure 6:
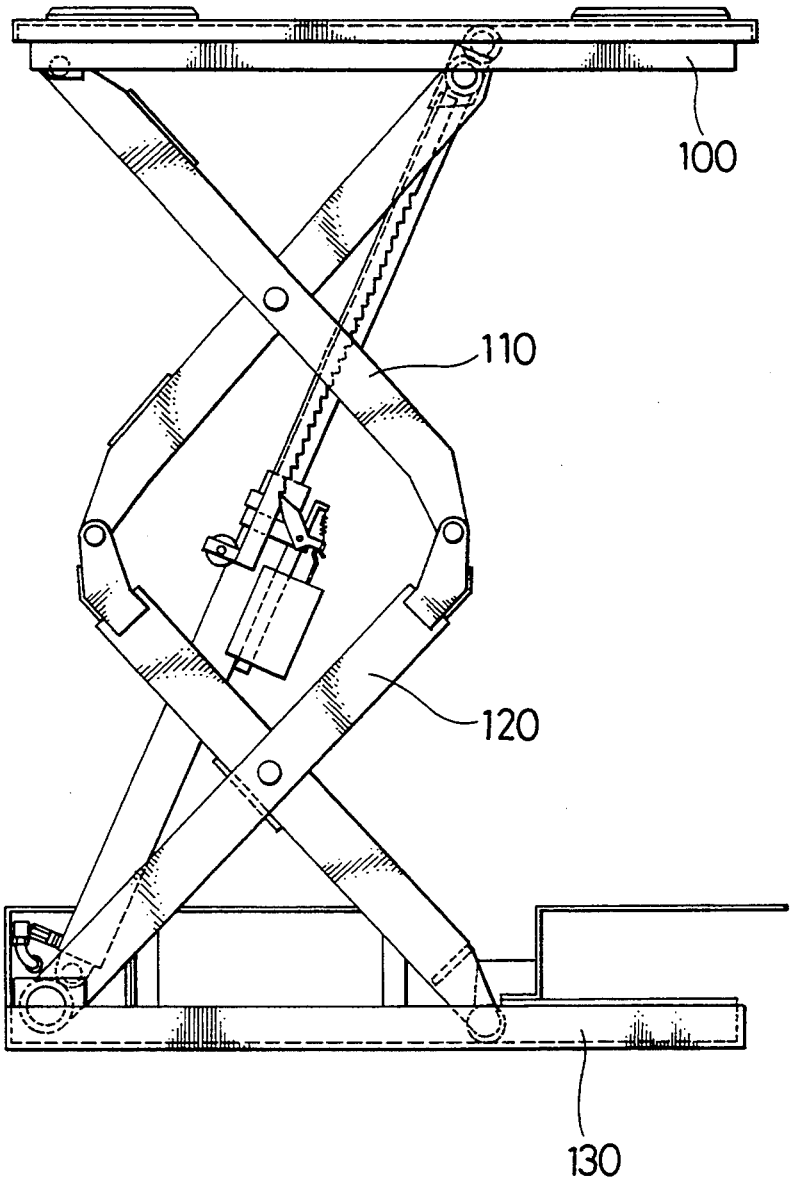
FIG. 6 PRIOR ART
FIG. 6 is a side view showing a conventional lift used for maintenance of automobiles.

FIG. 5 is a side view showing a lifting apparatus having an inclinable table as a second embodiment according to the invention.

A link mechanism 46 includes a long arm 46*a* having a first end fixed to a table 49 and a second end slidingly movable along a pair of curved rails 45,45, and a short arm 46*b* having a first end fixed to a connection shaft 43*a* on a base 41*a*. The long arm 46*a* crosses and is attached to the short arm 46*b* via a center shaft 43*b* to allow a pivotal movement of the long arm 46*a* with respect to the short arm 46*b*. The link mechanism 46 further includes a cylinder 40 with a piston 41 disposed between the table 49 and a second end of the short arm 46*b*. The stretching and contracting movement of the piston 41 with respect to the cylinder 40 changes the inclination of the table 49. This is preferably applied to pallets of parking lifts or vehicle-riding plates.

There may be many other modifications, alternations, and changes without departing from the scope or spirit of essential characteristics of the invention. It is thus clearly understood that the above embodiments are only illustrative and not restrictive in any sense. The scope and spirit of the present invention are limited only by the terms of the appended claims.

What is claimed is:

1. A lift used for maintenance of an automobile, said lift comprising (a) a table having a first side and a second side for supporting a lower body frame of said automobile.

(b) a base having a first side and a second side, and (c) a link mechanism comprising a short arm, a long arm having a first end and a second end and a middle disposed therebetween, and a push rod for moving said table in a vertical direction between an upper most position and a lower most position, said short arm having a first end fixed to the first side of said base to allow a pivotal movement of said short arm and an opposed second end, said long arm having fixed to said short arm at a position in the vicinity of the second end of said short arm and in the middle of said long arm to allow a pivotal movement of said long arm with respect to said short arm, said first end of said long arm being pivotably attached to the first side of said table and said second end of said long arm being slidably movable along a guide member having a sliding face, said guide member being formed on said first side of said base, said table descending to the lower most position and ascending to the upper most position in response to said sliding movement of the second end of said long arm along the sliding face of said guide member, wherein said push rod is adapted to pivotably join the second end of said short arm with said table at a position between an intersection of said short arm and said long arm and the first side of said table, wherein the sliding face of said guide member, which the second end of said long arm slidably moves along, has a compensation curve configured to compensate for the height of said long arm relative to said base to keep said table substantially parallel with said base during ascending or descending movement of said table.

2. A lift in accordance with claim 1, wherein said guide member comprises a pair of curved rails.

3. A lift in accordance with claim 2, wherein said long arm has a roller on its second end, which slidably moves along said pair of curved rails.

4. A lift in accordance with claim 1, wherein said push rod has a length adjustable by a turnbuckle mechanism.

5. A lift in accordance with claim 1, wherein said base is placed on a bottom of a pit having an opening and a pit cover, said pit cover having a first side rotatably fixed to the opening of said pit and a second side pressed up in response to the ascending or descending movement of said long arm and falling down to close said opening when said table is in its lower most position or in its upper most position.

* * * * *